United States Patent [19]

Scott et al.

[11] Patent Number: 4,948,536

[45] Date of Patent: Aug. 14, 1990

[54] AUTOMATIC CHOKE FOR SMALL TWO-CYCLE INTERNAL COMBUSTION ENGINES

[75] Inventors: William A. Scott, Mt. Zion; Mark A. Hutchinson; Gary L. Baumbarger, both of Decatur, all of Ill.

[73] Assignee: Tillotson, Ltd., Tralee, Ireland

[21] Appl. No.: 304,520

[22] Filed: Jan. 31, 1989

[51] Int. Cl.[5] ..... F02M 1/14

[52] U.S. Cl. ..... 261/64.4; 261/44.5

[58] Field of Search ..... 261/64.4, 64.6, 44.5

[56] References Cited

U.S. PATENT DOCUMENTS

| | | | |
|---|---|---|---|
| 921,410 | 5/1909 | Kaley | 261/64.4 |
| 1,176,627 | 3/1916 | Ver Planck | 261/64.4 |
| 1,391,931 | 9/1921 | Ball | 261/64.6 |
| 2,714,502 | 8/1955 | McClain | 261/44.5 |
| 3,484,220 | 12/1969 | Jones | 261/64.4 |
| 3,625,492 | 12/1971 | Reichenbach et al. | 261/64.4 |
| 3,907,944 | 9/1975 | Nakada | 261/64.4 |
| 3,939,231 | 2/1976 | Steele et al. | 261/64.6 |
| 4,212,276 | 7/1980 | Kaneda | 261/64.4 |
| 4,495,911 | 1/1985 | Andreasson | 261/64.6 |
| 4,539,162 | 9/1985 | Ferrell | 261/64.6 |
| 4,711,744 | 12/1987 | Scott et al. | 261/64.4 |

FOREIGN PATENT DOCUMENTS

| | | | |
|---|---|---|---|
| 33-17602 | 10/1958 | Japan | 261/64.6 |
| 303826 | 11/1929 | United Kingdom | 261/64.4 |
| 374026 | 5/1932 | United Kingdom | 261/64.4 |

*Primary Examiner*—Tim Miles

*Attorney, Agent, or Firm*—Harness, Dickey & Pierce

[57] ABSTRACT

An automatic choke assembly or starting aid is coupled with small internal combustion engines. The choke assembly is responsive to pressure differentials in the internal combustion engine which causes movement of a mechanism to control the amount of combustion air entering into the internal combustion engine. The mechanism provides sufficient combustion air during start-up and during continuous operation of the internal combustion engine.

3 Claims, 1 Drawing Sheet

AUTOMATIC CHOKE FOR SMALL TWO-CYCLE INTERNAL COMBUSTION ENGINES

BACKGROUND AND SUMMARY OF THE INVENTION

The present invention relates to chokes or starting aids for small internal combustion engines and, more particularly, for a choke or starting aid which is responsive to pressure differentials of the internal combustion engine.

When starting small internal combustion engines, it is usually necessary to pull on the starter rope several times before the engine kicks over and begins to run. Generally, after a couple of pulls on the starter rope, the engine starts and runs for a short period of time and then stops. This is what is commonly known in the field as a "false start". This "false start" phenomena has been present in the chain saw art for several years and has come to be accepted by the users of such saws as an acceptable starting method. The user generally has knowledge of the fuel system procedure and understands why the system is not starting.

The difficulty in starting a cold small internal combustion engine centers around the choke system of these particular engines. When the choke system is in a closed position, the fuel line system of a cold engine has a very high restriction in the air intake. This restriction of the air intake forms a vacuum in the fuel line, sucking fuel into the engine, via the carburetor, from the fuel tank. Also, a fuel bulb or the like may be coupled with the engine to force the fuel into the carburetor. As the starting rope is pulled, the engine sucks fuel into the carburetor by the vaccum created in the system. As the engine begins to fire, a certain amount of air is necessary to keep the engine running. With a manual choke, the user must open the choke quickly after the engine begins to run or the user will experience the "false start" phenomenon. The reason for the "false start" is that as the speed of the engine increases, the engine sucks more fuel. With the choke in a closed position however, the amount of air flow entering the engine is not increased. Thus, a proper mixture of air and fuel is not achieved and the engine dies instantly. Also, if the engine does not start up, a substantial amount of fuel is sucked into the engine, via the carburetor, causing the engine and carburetor to become flooded, further hampering the starting procedure of the engine.

Choke devices presently used in the field are of a butterfly type. These types of chokes are pivotally secured in the carburetor air port of an internal combustion engine. The choke usually pivots about a central axis, flipping from a closed to an open position. This type of choke assembly has several disadvantages. The choke is either in a fully closed or a fully open position. When starting the engine the choke is in the fully closed position. Once the engine starts, it is nearly impossible to rotate the choke to its open position, so that the engine will continue to run. Also, the butterfly valve may flip from a closed to an open position without notice to the user. This slippage is due to the fact that, in many instances, there is no resistance member holding the butterfly valve in position. Those skilled in the art are aware of yet other disadvantages of this type of choke assembly.

Another type of choke device that is present in the art is like that disclosed in U.S. Pat. No. 4,711,744 issued Dec. 8, 1987 to the assignee of the present invention, the specification of which is expressly incorporated by reference. This type of device works well in monitoring the amount of air entering into the internal combustion engine, however, designers are always striving to improve the art.

Accordingly, it is an object of the present invention to overcome the disadvantages of the above art. The present invention provides the art with a new and improved choke assembly which enables air to automatically enter the carburetor during start-up of an internal combustion engine to provide a continuous running situation. The present invention includes a mechanism responsive to pressure differentials in the internal combustion engine, which, in turn, controls the amount of air entering into the engine.

The choke assembly of the present invention provides the art with an automatic choke or starting aid. The choke assembly is generally for small internal combustion engines having a carburetor and a bore operatively associated with the carburetor. The bore has one end in communication with a source of combustion air and the other end in communicaiton with a piston cylinder. The choke includes a mechanism responding to pressure differentials in the internal combustion engines. The pressure responsive mechanism is associated with the bore and is positioned along the longitudinal axis of the bore. The mechanism which controls combustion air entering into the bore is coupled with and driven by the pressure responsive means. The control mechanism enables sufficient combustion air to be present during start-up and during continuous operation of the internal combustion engine.

From the subsequent description and the appended claims taken in conjunction with the accompanying drawings, other objects and advantages of the present invention will become apparent to those skilled in the art.

DETAILED DESCRIPTION OF THE PREFERRED EMBODIMENT

Figure 1:
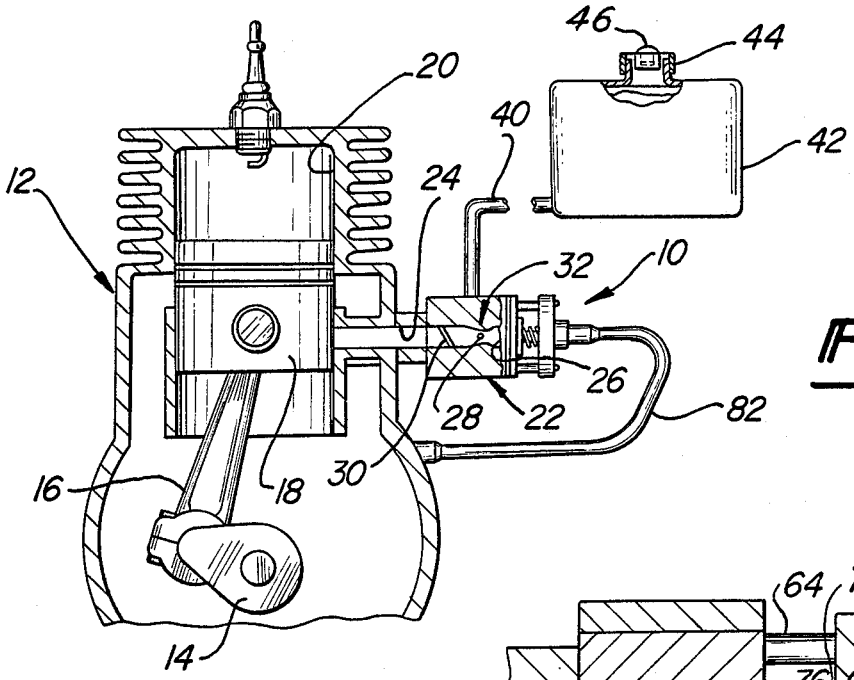
FIG. 1 is a side elevational view partially in cross section of a small internal and combustion engine having a choke assembly or starting aid in accordance with the present invention.

Referring to the Figures, a choke assembly or starting aid is shown in combination with the carburetor of an internal combustion engine and designated with the reference numeral 10. As best seen in FIG. 1, the choke assembly 10 is coupled with an internal combustion engine 12. Internal combustion engine 12 includes a crankshaft 14 having a piston rod 16 secured to it. Piston rod 16 has a piston head 18 which is slidably positioned in the piston cylinder 20 in the internal combustion engine 12. A carburetor 22 is coupled with the internal combustion engine 12 and is in communication with the piston cylinder 20 via a carburetor bore 24. The carburetor 22 provides a combustional air/fuel mixture to the piston cylinder 20 for driving the internal combustion engine 12. The carburetor 22 is in communication with an air inlet manifold 26 which in turn, is in communication with a source of combustion air, preferably atmospheric air. The choke assembly 10 is generally coupled with the air manifold 26 of the carburetor 22 of the internal combustion engine 12.

The carburetor 22 preferably of the diaphragm type, has a fuel inlet port 28 for providing fuel to the piston cylinder 20 for combustion in the piston cylinder 20. Carburetor 22 also has a throttle valve 30 for controlling the amount of air/fuel mixture which enters into the piston cylinder 20. Throttle valve 30 is pivotally positioned in the carburetor bore 24. A venturi 32 is formed in the carburetor bore 24 for enabling the air/fuel mixture to move more rapidly into the piston cylinder 20.

The inlet air manifold 26 is generally adjacent to and in communicaiton with the carburetor bore 24. Combustion air is drawn through the inlet air manifold 26 for supplying combustion air into the piston cylinder 20 via the carburetor 22.

As also seen in FIG. 1, the fuel inlet port 28 is coupled with a fuel line 40, which in turn, is coupled with a fuel tank 42. The fuel tank 42 has a rotatable, removable cap 44 which includes an atmospheric vent.

The choke 10 includes a housing 60, ordinarily two-piece, defining a cavity 62. The housing 60 has one or more support members 64 securing and positioning the housing 60 with the carburetor 22. The support member 64 are such that a gap or inlet 66 is formed between the carburetor air manifold 26 and the housing 60.

A diaphragm 68 is operatively secured by the housing 60 within the cavity 62. The diaphragm 68 moves in response to pressure differentials in the internal combustion engine 12. A plunger 70 is secured to the diaphragm 68. The plunger has a neck 72 directly connected to the diaphragm 68 and a planar head 74 adapted to cover the carburetor air manifold 26. A calibrated spring 76 is positioned about the periphery of neck 72 to provide resilient resistance against the diaphragm 68. The spring 76 returns the plunger 70 to a position covering the carbuertor air manifold 26 after the engine has been turned off. A inlet 80 enables pressure differentials to enter into the cavity 62, via conduit 82. The inlet 80 is coupled with a one-way valve 84 between the inlet 80 and conduit 82. The one-way valve 84 prevents positive pressure from entering into the cavity 62. Also, the housing 60 includes a nipple 86 which enables the conduit 82 to secure to the housing 60.

Figure 2:
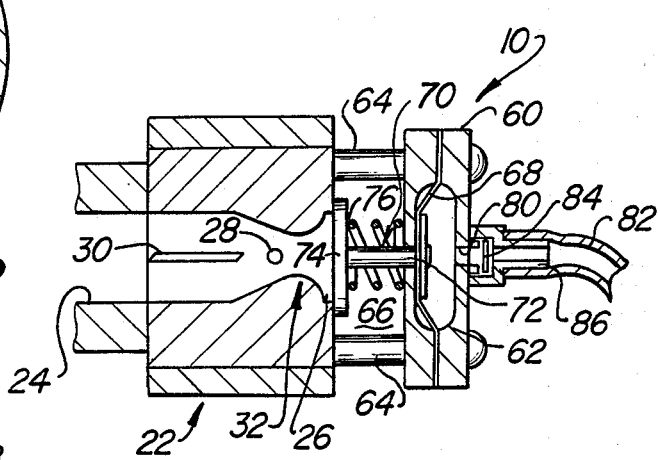
FIG. 2 is an enlarged cross section view of the choke assembly or starting aid of FIG. 1.
Figure 3:
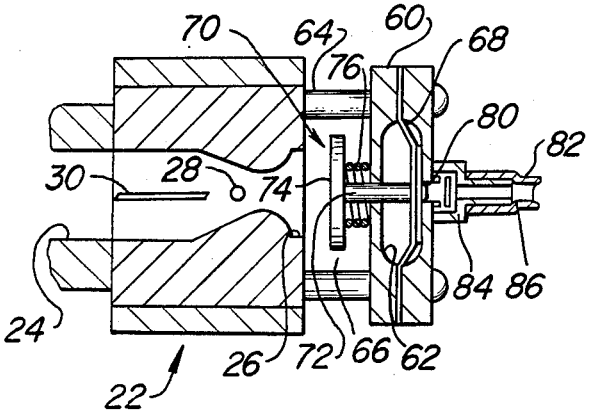
FIG. 3 is an enlarged cross section view like that of FIG 2.

The cold internal combustion 12 is started as follows. The operator pushes on the primer bulb 46, if one is present, turns on the ignition, if necessary, and turns the throttle valve 30 to an open position as seen FIG. 2, which may be accomplised by holding the trigger of an apparatus, such as a chainsaw. in a full open position. While the throttle valve 30 is fully open, the starter roper of the apparatus would be pulled several times (approximately three to four pulls). During the three or four pulls, the plunger 70 will remain covering the carburetor air manifold 26. During the initial pulling of the starter rope, the crankcase vacuum at the diaphragm 68 is approximately 1 inch of mercury. Once the engine fires and begins to run at full throttle, the crankcase vacuum increases to about 2 inches of mercury or an increase in vacuum of a ratio of about 2 to 1 . As the vacuum increases in the crankcase, the diaphragm 68 is pulled away from the one side of the cavity 62 to the opposite side of the cavity. As this occurs. the plunger is lifted away from the carburetor air manifold 26 as seen in FIG. 3. The vacuum enables the choke to work automatically such that when the starter rope is initially pulled, sufficient combustion air is present during start-up of the internal combustion engine. After the engine begins to run, the diaphragm 68 automatically draws against the top of a cavity 62, as seen in FIG. 3, enabling sufficient combustion air to enter the internal combustion engeine during continuous operation of the engine.

Figure 4:
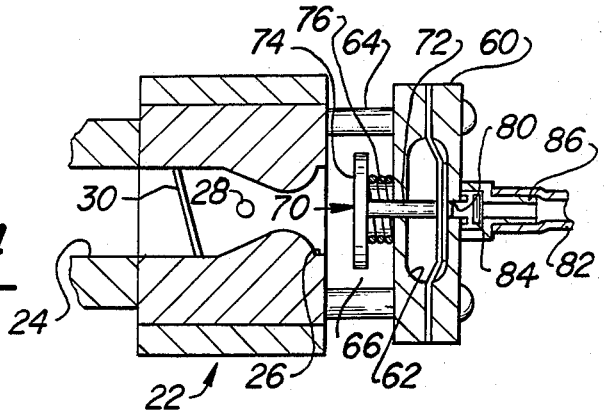
FIG. 4. is an enlarged cross section view like that of FIGS. 2 and 3.

The present invention also provides for the starting of an internal combustion engine during hot start restarting particularly when using diaphragm type carburetors. In these instances, the engine tends to become flooded due to the heat which enables fuel to siphon into the engine crankcase. During hot restart or extended shut down time, the engine may not start at a wide open throttle position as shown in FIG. 2. By setting the throttle at a fast idle position lock, as shown in FIG. 4, and pulling on the starter rope, the diaphragm 68 will sense the increase crankcase vacuum caused by the near closed throttle valve. While pulling the starter rope, the increased vacuum will repeatedly pull the plunger 70 away from the carburetor air manifold 26. This movement enables the engine to start and overcomes a over-rich or flooded condition.

While it will be apparent that the preferred embodiment is well calculated to fulfill the above-stated objects, it will also be appreciated that the present invention is susceptible to modification, variation, and alteration without varying from the scope and spirit of the subjoined claims.

What is claimed is:

1. An automatic choke for small internal combustion engines having a carburetor, a bore operatively associated with the carburetor and defining a longitudinal axis, the bore having one end in communication with a source of combustion air and another end of the bore in communication with a piston cylinder of the internal combustion engines, said choke comprising:

a housing coupled with said carburetor along said longitudinal axis, said housing positioned at the end of the bore in communication with the source of combustion air, means for spacing said housing from said carburetor, said means for spacing including a plurality of support member extending between said carburetor and said housing such that a gap is formed between said housing and said carburetor and between adjacent support members for enabling combustion air to enter said bore through the gap;

pressure responsive means operatively coupled with said housing and associated with the internal combustion engines, said pressure responsive means including a diaphragm positoned in said housing in alignment with said longitudinal axis such that said diaphragm automatically moves in said housing in response to pressure changes in the internal combustion engine;

means for automatically controlling combustion air entering said bore, said controlling means including a plunger with a neck coupled with said diaphragm and a head adapted to cover the bore, said plunger head and a portion of said neck positioned outside of said housing, and a spring biasing said plunger against force of said diaphragm, said spring surrounding said neck and abutting said head and housing, said controlling means coupled with said pressure responsive means such that movement of said diaphragm moves said plunger axially so that said plunger head enables sufficient combustion air to enter said bore during start up and during continuous operation of the internal combustion engine such that at start up of the engine said plunger head opens and closes the end of the bore and during continuous operation of the engine the plunger head automatically opens said bore and enabling combustion air to enter the engine.

2. The automatic choke according to claim 1 wherein said pressure responsive means diaphragm is responsive to vacuum changes in said internal combustion engine.

3. The automatic choke according to claim 1 wherein said housing includes a one-way valve for preventing positive pressure from entering into said housing.

* * * * *